United States Patent [19]

Leroy et al.

[11] 4,045,213

[45] Aug. 30, 1977

[54] METHOD OF INJECTING A POWDER CONTAINING CARBON INTO A METAL BATH

[75] Inventors: Pierre Leroy, Saint-Germain-En-Laye; Jean Bastien, L'Etrat; Jean-Claude Muller; Roger Kieger, both of Guenange, all of France

[73] Assignees: Creusot-Loire; Societe Lorraine de Laminage Continu-Sollac, both of Paris, France

[21] Appl. No.: 762,944

[22] Filed: Jan. 27, 1977

Related U.S. Application Data

[63] Continuation of Ser. No. 634,466, Nov. 24, 1975, abandoned.

[30] Foreign Application Priority Data

Nov. 28, 1974 France ..... 74.38955

[51] Int. Cl.[2] ..... C21C 7/00

[52] U.S. Cl. ..... 75/48; 75/51; 75/59; 266/47

[58] Field of Search ..... 75/51, 52, 59, 60, 48; 266/47, 221, 222

[56] References Cited

U.S. PATENT DOCUMENTS

| | | | |
|---|---|---|---|
| 1,968,917 | 8/1934 | Soldatoff | 75/48 |
| 3,607,227 | 9/1971 | Stephenson et al. | 75/48 |
| 3,859,078 | 1/1975 | Haysom et al. | 75/59 |
| 3,897,047 | 7/1975 | Kolb et al. | 75/60 |

*Primary Examiner*—M. J. Andrews

[57] ABSTRACT

In a method of deoxidizing and/or carburizing a metal, particularly steel, bath using an immersed nozzle consisting of two concentric tubes, the central tube of the nozzle is fed with an oxidizing gas during the or each oxidation phase, then with a scavenging gas, then with a neutral gas carrying carbon powder or powder containing carbon during the or each deoxidation or carburization phase and finally with a scavenging gas, the outer tube of the nozzle being fed with a protective fluid or different protective fluids during both the oxidation and deoxidation or carburization phases.

7 Claims, 3 Drawing Figures

METHOD OF INJECTING A POWDER CONTAINING CARBON INTO A METAL BATH

This is a continuation of application Ser. No. 634,466 filed Nov. 24, 1975, now abandoned.

The present invention relates to a method of injecting a carbon powder or a powder containing carbon into a metal bath, with a view to deoxidizing or carburizing the bath. The invention has particular but not exclusive application to a steel bath at the end of production.

One method which is frequently used, among others, for introducing the deoxidizing or carburizing carbon, consists in blowing in, by means of a lance, carbon powder or a powder containing carbon in suspension in a carrier gas. The lance is introduced through the nose of a converter in a horizontal position, or through a door in an open-hearth furnace or in an electric furnace.

This conventional method has a certain number of disadvantages:

a. It requires a special blowing device which is movable over the work floor in front of the converter or in front of the furnace.

b. This device is bulky.

c. The lance blows the carbon on to the surface of the bath because it never penetrates far into the bath.

d. Flames and dust make this method very uncomfortable for the operating personnel.

These disadvantages can be avoided by replacing the injection lance by a nozzle which blows the powdery carbon below the surface of the metal bath, that is to say which is immersed.

But with an immersed nozzle, the difficulties which arise are complex. Graphite powder is compatible with air but not with pure oxygen, for obvious reasons of safety. Now it is an advantage for the nozzle in question to also serve for the refining of the bath, by blowing an oxidizing gas, which may be pure oxygen, during the oxidation phases, and then to serve for the deoxidation or the carburization of this bath. But carbon powder must not remain lodged in the circuit and then explode when oxygen is admitted.

In order to avoid this serious risk, a first method, consisting in using a triple nozzle, that is to say with three concentric tubes, has been proposed.

The object of the present invention is likewise to avoid the aforesaid risk and likewise to operate safely, but using a double nozzle, that is to say with two concentric tubes, which is a more simple embodiment than a triple nozzle.

According to the present invention there is provided a method of deoxidizing and/or carburizing a metal bath, particularly a steel bath, by injecting into the bath carbon powder or a powder containing carbon by means of at least one immersed nozzle consisting of two concentric tubes, the method comprising feeding the central tube of said nozzle successively with an oxidizing gas, which may be pure oxygen, during the oxidatio phase or phases, then with a scavenging gas, then with a neutral gas carrying said carbon powder or powder containing carbon during the deoxidation or carburization phase or phases, and finally with a scavenging gas before repeating the cycle, while feeding said peripheral tube successively with a fluid protecting said nozzle against wear during the oxidation phase or phases, and with this same fluid or another protective fluid during the deoxidation or carburization phase or phases.

The central tube of the or each deoxidizing or carburizing nozzle may be supplied by two distinct pipes, the first of the two pipes being fed selectively with oxidizing gas or with scavenging gas, and the second of the two pipes being fed selectively with a neutral gas carrying the carbon powder or containing carbon, or with a scavenging gas.

The two pipes may each include, upstream of their junction, a valve, which may be automatic, and each of the valves may be closed when the other one is open. The valves are advantageously ball valves with total opening.

The scavenging gas may advantageously be nitrogen, argon or carbon dioxide gas, according to circumstances.

The gas carrying carbon powder or powder containing carbon is, in principle, a neutral gas such as nitrogen or argon. It is often an advantage to effect slagging of the bath during the scavenging separating the oxidation and deoxidation phases.

As will be understood, it is the scavenging, separating the oxidation phase from the deoxidation or carburization phase, and vice versa, which ensures the safety. Valves, well disposed and possibly automatic, should prevent any false operation.

The invention will be more fully understood from the following description of an embodiment thereof, given by way of example only, with reference to the accompanying drawings.

In a converter for 60 tons of steel per casting, with pure oxygen blown from the bottom upwards, there are available at the bottom of the converter seven nozzles with two concentric tubes, only one of which is used in accordance with the invention for deoxidation or carburization of the metal bath.

Figure 1:
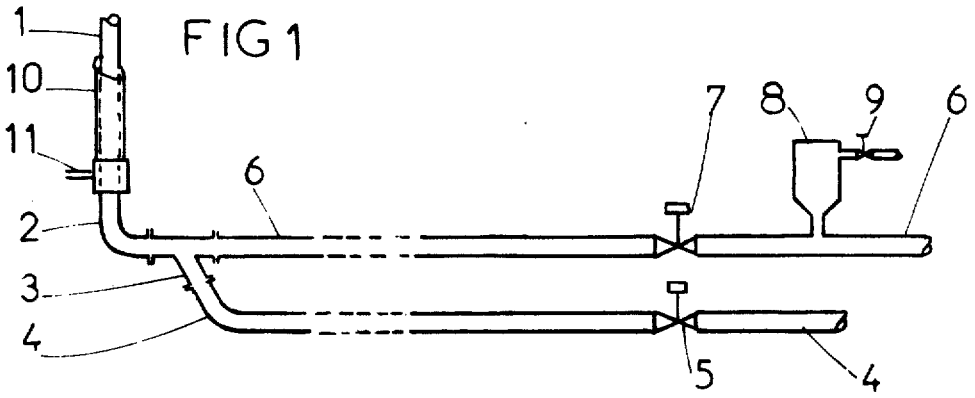
FIG. 1 is a diagram of a nozzle feed circuit for use in an embodiment according to the invention.

As shown in FIG. 1, the central tube 1 of the nozzle is connected to an elbowed pipe portion 2, itself connected to a connection 3 in the form of a Y. The branch 4 of the Y is fed with pure oxygen via valve 5 and it can also be supplied with nitrogen. The branch 6 of the Y is fed with nitrogen via valve 7.

The branch 6 can also receive graphite powder supplied from a powder distributor 8, the internal pressure of which is regulated by manipulating a valve 9.

The external tube 10 of said nozzle is supplied via a pipe 11 either with fuel oil or with nitrogen.

The metallurgical operation comprises two phases of very unequal duration.

1st phase: duration: 12 minutes. This is the oxidation phase, or actual conversion phase.

During this first phase, the seven double nozzles blow pure oxygen at a mean total rate of 250 $Nm^3$/minute, consuming 1.5 liters of protective fuel oil per minute of blowing and per nozzle. For the special nozzle used in accordance with the invention, the valve 5 is open, while the valve 7 is closed.

At the end of this oxidation phase, the oxygen in the pipe 4 is replaced by nitrogen. The valve 7 is then opened, admitting nitrogen without graphite powder, while the valve 5 closes and the valve 9 remains closed. Thus a first scavenging of the branch 4, of the connection 3, of the elbow 2 and of the central tube 1 is effected by nitrogen which has passed through the valve 5, and then a second scavenging is effected by means of the nitrogen from branch 6 via valve 7.

2nd phase: Duration: 1 minute.

This is the deoxidation and possible carburization phase, after the slagging off of the slag which is formed between the two phases.

During this second phase, both circuits of six of the seven double nozzles are fed with nitrogen, while the double nozzle used in accordance with the invention is fed with nitrogen containing graphite powder in its central tube and with nitrogen without powder in its external tube.

In this second phase, the valve 5 remains closed, the valve 7 remains open and the valve 9 opens, in order to increase the internal pressure of the powder distributor and so to introduce a certain amount of graphite powder into the branch 6.

Thus, the central tube 1 of the nozzle applying the invention may receive, for example, a supply of nitrogen of 20 $Nm^3$/minute holding in suspension 3 Kg of graphite powder per standard cubic meter of nitrogen, while the external tube 10 of said nozzle is traversed by a small supply of scavenging nitrogen, without powder.

For a consumption of powdered carbon of 60 Kg, and bearing in mind the stirring of the bath by the nitrogen, the oxygen content of the steel is brought from 0.100 to 0.050%, for a carbon content which passes from 0.20 to 0.050%, while its nitrogen content only increases by 0.0007%, passing from 0.0030 to 0.0037%.

Figure 2:
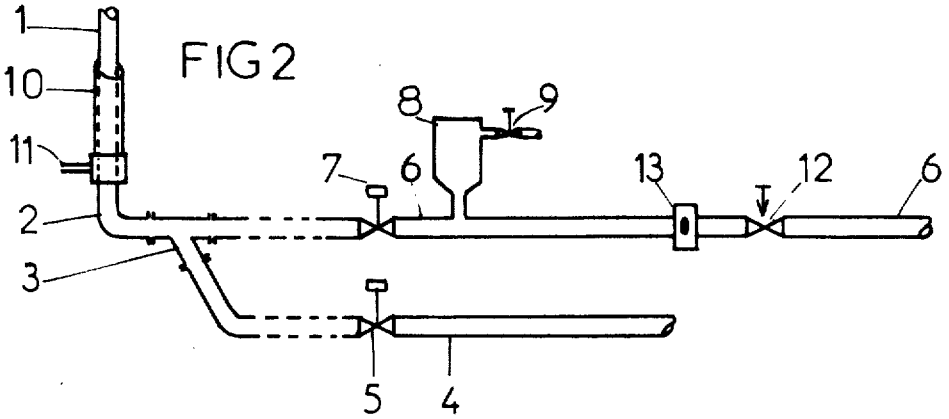
FIG. 2 is a first modification of the circuit of FIG. 1.
Figure 3:
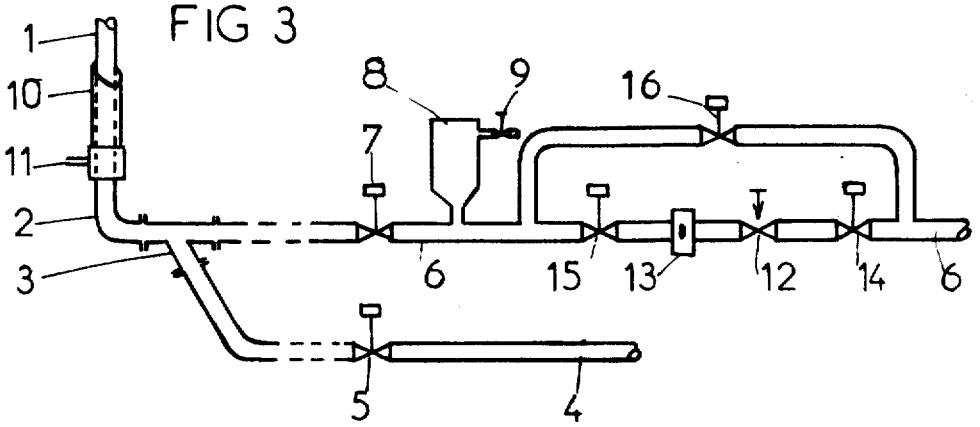
FIG. 3 is a second modification of the circuit of FIG. 1.

For greater safety, if there is any fear that the valve 7 is not gas-tight when it is closed and that therefore, during the first oxidation phase, there is a risk of oxygen flowing back in the pipe 6 upstream of the valve 7, the circuit arrangement may advantageously be modified as shown in FIG. 2 or FIG. 3, both of which ensure a nitrogen pressure upstream of the closed valve 7, this nitrogen pressure being regulated in such a manner that the oxygen from the pipe 4 cannot flow back upstream of the valve 7.

According to FIG. 2, the pipe 6 comprises successively, in a downstream direction: a regulating valve 12, a flowmeter 13, the outlet orifice of the carbon powder distributor 8, the valve 7 and the Y connection 3.

During the first oxidation phase, the valve 7 is closed and the regulating valve 12 is kept open so that the nitrogen pressure upstream of the valve 7 is equal to the feed pressure, since there is practically no flow. This nitrogen pressure is regulated in such a manner that it opposes any upstream flow of oxygen through the valve 7 if this is not completely gas-tight.

During the second deoxidation and carburization phase, the valves 7, 9 and 12 are open. The opening of the valve 12 is such that the conveying of the required supply of carbon powder is effected under satisfactory conditions. The nitrogen supply is measured by the flowmeter 13.

According to FIG. 3, the pipe 6 comprises successively, in a downstream direction: a first automatic valve 14, the regulating valve 12, the flowmeter 13, a second automatic valve 15, the outlet orifice of the carbon powder distributor 8, the valve 7, and the Y connection 3. In addition, a by-pass controlled by a valve 16 is provided connecting the pipe 16 upstream of the valve 14 and downstream of the valve 15.

In the first oxidation phase, the valves 7, 9, 12, 14, 15 are closed, but the by-pass valve 16 is open establishing upstream of the valve 7 a nitrogen pressure regulated by the valve 16 to oppose any upstream flow of oxygen through the valve 7 if this is not gas-tight.

In the second phase, the valve 16 is closed, while the valves 7, 9, 12, 14 and 15 are open. Again the regulating valve 12 determines the appropriate flow of nitrogen to convey the required supply of carbon powder originating from the distributor 8.

It is understood that it is possible, without departing from the scope of the invention, to design variants and improvements to details, as well as to consider the use of equivalent means.

Thus, in certain special cases, the oxidizing nozzles may operate with oxygen, and at the same time the deoxidizing and carburizing nozzle or nozzles according to the invention may operate with carbon powder, and with the various fluids which normally accompany this powder in the deoxidizing phase. In this variant, the oxidizing nozzles are in the oxidizing phase, and the nozzle or nozzles according to the invention are in the deoxidizing phase, at the same moment. This may lead to certain metallurgical advantages.

The invention is particularly well applicable to the converters of pure oxygen steel plants, both those which blow through the bottom, from the bottom upwards, and the converters with a vertical lance.

What is claimed is:

1. A method of deoxidizing or carburizing a ferrous metal bath by injecting into the bath a carbon powder by means of at least one immersed nozzle consisting of two concentric tubes, the method comprising feeding the central tube of said nozzle successively with pure oxygen during the oxidation phase or phases, then with a scavenging gas, selected from the group consisting of nitrogen, argon and carbon dioxide and then with a neutral gas carrying said carbon powder during the deoxidation or carburization phase or phases, and finally with said scavenging gas before repeating the cycle, while feeding said peripheral tube successively with a fluid protecting said nozzle against wear during the oxidation phase or phases, and with this same fluid or another protective fluid during the deoxidation or carburization phase or phases and wherein the central tube of said nozzle is supplied by two distinct pipes, the first of the two pipes being fed selectively with pure oxygen or with said scavenging gas, the second of the two pipes being fed selectively with said neutral gas carrying the carbon powder or with said scavenging gas and wherein any contact between pure oxygen and carbon powder is avoided.

2. A method as claimed in claim 1, wherein two valves are each connected in a respective one of the two pipes and are each closed when the other is open.

3. A method as claimed in claim 1, wherein the scavenging gas and the gas carrying carbon powder are nitrogen.

4. A method as claimed in claim 1, wherein the scavenging gas is carbon dioxide gas and the gas carrying carbon powder is nitrogen or argon.

5. A method as claimed in claim 1, wherein the protective fluid during the oxidation phase or phases is fuel oil and the protective fluid during the deoxidation or carburization phase or phases is nitrogen.

6. A method as claimed in claim 1, wherein slagging of the metal bath is effected between the oxidation phase or phases and the deoxidation or carburization phase or phases.

7. A method as claimed in claim 2, wherein said valves are automatic valves.

* * * * *